US007490658B2

(12) United States Patent
Sasaki et al.

(10) Patent No.: US 7,490,658 B2
(45) Date of Patent: Feb. 17, 2009

(54) INTERNALLY GROOVED HEAT TRANSFER TUBE FOR HIGH-PRESSURE REFRIGERANT

(75) Inventors: Naoe Sasaki, Nagoya (JP); Takashi Kondo, Gamagori (JP); Shiro Kakiyama, Nagoya (JP)

(73) Assignee: Sumitomo Light Metal Industries, Ltd., Tokyo (JP)

( * ) Notice: Subject to any disclaimer, the term of this patent is extended or adjusted under 35 U.S.C. 154(b) by 0 days.

(21) Appl. No.: 11/736,311

(22) Filed: Apr. 17, 2007

(65) Prior Publication Data

US 2007/0199684 A1 Aug. 30, 2007

Related U.S. Application Data

(63) Continuation of application No. PCT/JP2005/021672, filed on Nov. 25, 2005.

(30) Foreign Application Priority Data

Dec. 2, 2004 (JP) ..... 2004-350357

(51) Int. Cl.
*F28F 13/18* (2006.01)
*F28F 1/14* (2006.01)
*F28D 1/02* (2006.01)

(52) U.S. Cl. ..... 165/133; 165/151; 165/179; 165/184

(58) Field of Classification Search ..... 165/133, 165/184, 151, 179; 29/890.048, 890.049
See application file for complete search history.

(56) References Cited

U.S. PATENT DOCUMENTS

| | | | | |
|---|---|---|---|---|
| 3,273,599 | A * | 9/1966 | Hermann | 138/38 |
| 5,275,234 | A * | 1/1994 | Booth | 165/133 |
| 5,692,560 | A * | 12/1997 | Messant et al. | 165/151 |
| 6,067,712 | A * | 5/2000 | Randlett et al. | 29/890.053 |
| 6,308,775 | B1 * | 10/2001 | Naumann | 165/133 |
| 6,533,030 | B2 * | 3/2003 | Mitrovic et al. | 165/184 |

FOREIGN PATENT DOCUMENTS

| | | | |
|---|---|---|---|
| JP | 08-049992 | A1 | 2/1996 |
| JP | 08049992 | A * | 2/1996 |
| JP | 10-260000 | A1 | 9/1998 |
| JP | 2001-153571 | A1 | 6/2001 |
| JP | 2002-031488 | A1 | 1/2002 |

(Continued)

*Primary Examiner*—Tho v Duong
(74) *Attorney, Agent, or Firm*—Burr & Brown

(57) ABSTRACT

An internally grooved heat transfer tube for a cross fin tube type heat exchanger of a refrigerating air-conditioning water supply apparatus using a high-pressure refrigerant, wherein an intra-tubular heat transfer rate is improved while maintaining a sufficient strength for pressure resistance.

A heat transfer tube formed of copper or copper alloy has internal fins between internal grooves. In the tube, t/D is not smaller than 0.041 and not greater than 0.146, $d^2/A$ is not smaller than 0.75 and not greater than 1.5, where D [mm] is an outside diameter of the tube, t [mm] is a groove bottom thickness, d [mm] is a depth of each groove, and A [$mm^2$] is a cross sectional area of each groove. N/Di is not smaller than 8 and not greater than 24 where N is a number of grooves, and Di is a maximum inside diameter corresponding to an inside diameter of the tube.

12 Claims, 3 Drawing Sheets

FOREIGN PATENT DOCUMENTS

| | | | | |
|---|---|---|---|---|
| JP | 2002-090086 | A1 | | 3/2002 |
| JP | 2003-269822 | A1 | | 9/2003 |
| JP | 2003-343942 | A1 | | 12/2003 |
| JP | 2004-279025 | A1 | | 10/2004 |
| JP | 2004-301495 | A1 | | 10/2004 |
| JP | 2004301495 | A | * | 10/2004 |
| JP | 2005-188789 | | | 7/2005 |
| JP | 2006-064311 | | | 3/2006 |
| JP | 2006-105525 | | | 4/2006 |

* cited by examiner

INTERNALLY GROOVED HEAT TRANSFER TUBE FOR HIGH-PRESSURE REFRIGERANT

This application is a continuation of the International Application No. PCT/JP2005/021672 filed Nov. 25, 2005, which claims the benefit under 35 U.S.C. § 119(a)-(d) of Japanese Patent Application 2004-350357, filed Dec. 2, 2004, the entireties of which are incorporated herein by reference.

TECHNICAL FIELD

The present invention relates to an internally grooved heat transfer tube for a heat exchanger used in various types of refrigerating air-conditioning water heater apparatus. More particularly, the invention relates to such an internally grooved heat transfer tube for a cross fin tube type heat exchanger using a high-pressure refrigerant whose typical example is a carbon dioxide gas.

BACKGROUND OF THE INVENTION

Conventionally, a heat exchanger which works as an evaporator or a condenser is employed in air-conditioning equipment such as a home air conditioner, a vehicle air conditioner or a package air conditioner, a refrigerator or the like. In the home air conditioner for indoor use and the package air conditioner for business use, a cross fin tube type heat exchanger is the most generally used. The cross fin tube type heat exchanger is constructed such that aluminum plate fins on an air side and heat transfer tubes (copper tubes) on a refrigerant side are fixed integrally to each other. As the heat transfer tube for such a cross fin tube type heat exchanger, there is well known a so-called internally grooved heat transfer tube which includes a multiplicity of spiral grooves formed on its inner surface so as to extend with a prescribed lead angle with respect to an axis of the tube and internal fins having a predetermined height and each formed between adjacent two of the grooves.

In such an internally grooved heat transfer tube, for attaining high performance of the heat exchanger, the internal grooves are made deeper and the internal fins formed between the grooves are made narrower. Further, there have been proposed various heat transfer tubes which purse high performance by optimizing the groove depth, an apex angle of the internal fins, the lead angle, a cross sectional area of the grooves and so on.

As a refrigerant used in this kind of cross fin tube type heat exchanger, there have been conventionally used fluorocarbon refrigerants (Freon refrigerants) such as R-12, R-22 and the like in view of the danger of catching fire and exploding at the time of leakage thereof and the efficiency of the heat exchanger. However, as the global environmental problems become serious in these years, CFC and HCFC refrigerants containing chlorine are being replaced with HFC refrigerants from the standpoint of prevention of destruction of the ozone layer. Further, among those HFC refrigerants, R-407C and R-410A having relatively high global warming potential are being positively replaced, from the standpoint of prevention of global warming, with other HFC refrigerants such as R-32 having low global warming potential and natural refrigerants such as a carbon dioxide gas, propane and isobutene. In particular, because the carbon dioxide gas refrigerant has no toxicity to human bodies and non-flammability, unlike other natural refrigerants such as propane, the danger of catching fire or the like due to its leakage is low. Accordingly, the carbon dioxide gas has been attracting attention as a refrigerant used in an air-conditioning refrigerating water supply system having an air-conditioning function and a refrigerating or freezing function.

Where such a carbon dioxide gas ($CO_2$) is used as the refrigerant for the refrigerating air-conditioning water supply apparatus, however, a supercritical cycle is applied in which a pressure region above a critical point of the refrigerant is utilized on a high-pressure side, unlike a refrigerating cycle of a heat exchanger using ordinary HFC refrigerants and so on. The pressure on the high-pressure side varies depending upon use or application of the heat exchanger (freezing, air conditioning, water supply). In considering a maximum operating pressure of the heat exchanger, reliability evaluating conditions of a compressor for the water supply system is referred to. For instance, in a long-time reliability test for evaluating the reliability of the compressor for the water supply system, the operating pressure of about 15 MPa is employed. While there is data that a coefficient of performance (COP) of such a water supply system becomes maximum around 12 MPa, it is preferable to design the heat exchanger so as to have pressure resistance at its operating pressure of about 15 MPa at maximum, in consideration of unexpected changes in operating conditions. Namely, in a case where the conventional refrigerants are used, the heat exchanger is operated at a pressure of about 1-4 MPa. In contrast, where the carbon dioxide gas refrigerant is used, the heat exchanger is operated at a high pressure of 5-15 MPa, which is about five times higher than that in the conventional case.

Thus, in the cross fin tube type heat exchanger using the carbon dioxide gas refrigerant, since the heat transfer tube (the internally grooved heat transfer tube) through which the refrigerant flows tends to suffer from a considerably high pressure, it is required to enhance the strength for pressure resistance of the heat transfer tube. For this end, there are employed various techniques such as a reduction in the diameter of the heat transfer tube, a change in the material for the tube, an increase in the groove bottom thickness, etc. As the techniques of the reduction in the diameter of the heat transfer tube and the change in the material for the tube, JP-A-2002-31488 (Patent Publication 1) discloses, for instance, use of small-diameter copper or stainless tubes. In JP-A-2001-153571 (Patent Publication 2), for instance, a heat exchanger is formed by flat, elliptical aluminum tubes with a multiple holes. However, the change in the material for the heat transfer tube to stainless or aluminum undesirably may result in deteriorated workability of the tube or poor bonding of the tube. Accordingly, it is preferable that the material for the heat transfer tube be copper or a copper alloy. In the above-indicated Patent Publication 1, the small-diameter copper-made heat transfer tube is disclosed. The disclosed heat transfer tube, however, has a smooth inner surface and accordingly its heat transfer performance is insufficient as compared with the internally grooved heat transfer tube. Therefore, from the viewpoint of improvement in the heat transfer performance, it is desired to provide the internally grooved heat transfer tube having a high degree of strength for pressure resistance and made of the copper or copper alloy.

In the internally grooved heat transfer tube made of the copper, there are employed, for enhancing the strength for pressure resistance, various techniques such as the reduction in the outside diameter of the tube and the increase in the groove bottom thickness which is a thickness of the tube at a portion thereof corresponding to each groove formed on its inner surface. As for the reduction in the diameter of the tube, it is possible to reduce the diameter from about 7 mm that is a generally employed value to about 4 mm. In a heat exchanger of an air cooling type, the heat transfer tube is fixed to heat-dissipating fins usually according to a mechanical tube-expanding method in which a tube-expanding plug is inserted through the heat transfer tube for expanding the tube, whereby the heat transfer tube is brought into close contact with and fixed to the heat-dissipating fins in mounting holes formed in the fins. Therefore, it is technically difficult to fix the heat transfer tube with the diameter of 6 mm or smaller to the heat-dissipating fins by the mechanical tube-expanding method. In the meantime, in a case where the strength for pressure resistance is enhanced by increasing the groove bottom thickness, a large force is required in the mechanical tube-expanding operation for expanding the tube wall with increased groove bottom thickness by the tube-expanding plug inserted in the tube. Accordingly, it is rather difficult to employ the mechanical tube-expanding method unless the heat transfer tube with a relatively large diameter is used. As another method for expanding the tube, there is known a hydraulic tube-expanding method in which a liquid is charged into a fluid-tightly sealed heat transfer tube and a pressure is applied to the charged fluid, thereby expanding the tube. This hydraulic tube-expanding method requires a complicated arrangement and is inferior in view of mass production.

Further, in the current technique of manufacturing the internally grooved heat transfer tube, since the groove depth tends to be decreased with an increase in the groove bottom thickness, it is difficult to improve the heat transfer performance of the internally grooved heat transfer tube by employing techniques for attaining high performance such as an increase in the height of the internal fins and a decrease in the width of the internal fins. In addition, in the case where the groove bottom thickness is increased, a large force acts on the tube when the tube is expanded by the mechanical tube-expanding method, causing a problem that the fins are collapsed due to the pressure upon the mechanical tube expanding if the fins each formed between adjacent two grooves on the inner surface of the tube are configured to have an increased height or an increased width.

In the light of the foregoing, it is not preferable from the viewpoint of the design for pressure resistance to employ the conventional internally grooved heat transfer tube whose performance has been enhanced by the increase in the height of the fins or the decrease in the width of the fins, as the internally grooved heat transfer tube used for the heat exchanger of the refrigerating air-conditioning water supply apparatus using the refrigerant whose pressure is higher than that of the conventionally used refrigerant. Further, it is not desirable to change the material for the heat transfer tube and reduce the outside diameter of the tube in an attempt to improve the strength for pressure resistance since the change in the material and the reduction in the tube diameter lead to deteriorated workability. Moreover, where the strength for pressure resistance is enhanced simply by increasing the groove bottom thickness, the groove depth is reduced due to limitation in working under the present circumstances. Therefore, it is indispensable to develop a groove structure which assures high heat transfer performance, on the premise that the groove depth is made smaller than before.

Patent Publication 1: JP-A-2002-31488

Patent Publication 2: JP-A-2001-153571

SUMMARY OF THE INVENTION

The present invention has been made in the light of the background situations noted above. It is an object of the invention to provide an internally grooved heat transfer tube for a cross fin tube type heat exchanger of a refrigerating air-conditioning water supply apparatus using a high-pressure refrigerant as exemplified in a carbon dioxide gas, in which an intra-tube heat transfer rate is improved while maintaining sufficient strength for pressure resistance.

As a result of an extensive study made by the inventors of the present invention to attain the object indicated above, it has been found the following: In the internally grooved heat transfer tube for the cross fin tube type heat exchanger, which is formed of copper or a copper alloy, and which includes: a multiplicity of grooves formed on an inner surface of the tube so as to extend in a circumferential direction of the tube or extend with a prescribed lead angle with respect to an axis of the tube; and internal fins having a prescribed height and each formed between adjacent two of the grooves, the groove structure was reviewed. Consequently, it has been found that a sufficiently high degree of heat transfer performance was obtained while assuring the strength for pressure resistance that permits use of the high-pressure carbon dioxide gas, by specifying a relationship between the depth of the grooves and the cross sectional area of the grooves as well as a relationship between the outside diameter of the tube and the groove bottom thickness while maintaining a predetermined relationship between a number of the grooves and a maximum inside diameter of the tube.

The present invention was completed based on the findings noted above and provides an internally grooved heat transfer tube for a high-pressure refrigerant which is used for a cross fin tube type heat exchanger using a high-pressure refrigerant and which is formed of copper or a copper alloy, the heat transfer tube including: a multiplicity of grooves formed in an inner surface thereof so as to extend in a circumferential direction of the tube or extend with a predetermined lead angle with respect to an axis of the tube; and internal fins having a predetermined height and each formed between adjacent two of the multiplicity of grooves, characterized in that: t/D ranges from not smaller than 0.041 to not greater than 0.146 and $d^2/A$ ranges from not smaller than 0.75 to not greater than 1.5 where an outside diameter of the tube is represented as D [mm], a groove bottom thickness which is a wall thickness of the tube at a portion thereof corresponding to each groove is represented as t [mm], a depth of each groove is represented as d [mm], and a cross sectional area of each groove taken in a cross sectional plane perpendicular to the axis of the tube is represented as A [$mm^2$]; and N/Di ranges from not smaller than 8 to not greater than 24 where a number of the grooves is represented as N and a maximum inside diameter of the tube which corresponds to an inside diameter of the tube formed by connecting bottoms of the grooves is represented as Di.

In one preferred form of the above-indicated internally grooved heat transfer tube according to the present invention, the high-pressure refrigerant advantageously has a pressure of 5-15 MPa.

In the internally grooved heat transfer tube according to the present invention, a carbon dioxide gas is advantageously used as the high-pressure refrigerant.

In the present invention, each of the internal fins advantageously has a transverse cross sectional shape of a trapezoidal shape with a flat or arcuate top or a triangular shape.

In another preferred form of the internally grooved heat transfer tube according to the present invention, the outside diameter (D) of the tube is in a range of 1-12 mm.

In still another preferred form of the internally grooved heat transfer tube according to the present invention, the groove bottom thickness (t) is in a range of 0.29-1.02 mm.

In a yet another preferred form of the internally grooved heat transfer tube according to the present invention, the depth (d) of each groove is in a range of 0.08-0.17 mm.

In a further preferred form of the internally grooved heat transfer tube according to the present invention, the cross sectional area (A) of each groove is in a range of 0.004-0.038 $mm^2$.

In a yet further preferred form of the internally grooved heat transfer tube according to the present invention, the number (N) of the multiplicity of grooves is in a range of 30-150 per circumference of the tube.

In the internally grooved heat transfer tube according to the present invention, the lead angle of the multiplicity of grooves with respect to the axis of the tube is advantageously in a range of 10°-50°.

In another preferred form of the internally grooved heat transfer tube according to the present invention, each of the internal fins has an apex angle in a range of 0°-50°.

The present invention also provides a refrigerating air-conditioning water supply apparatus equipped with a cross fin tube type heat exchanger formed by using the above-indicated internally grooved heat transfer tube.

In the internally grooved heat transfer tube for a high-pressure refrigerant according to the present invention, the strength for pressure resistance and the heat transfer performance can be improved at one time. Accordingly, the high-pressure refrigerant whose typical example is a carbon dioxide gas can be advantageously used in a cross fin tube type heat exchanger formed by using the internally grooved heat transfer tube constructed as described above.

DESCRIPTION OF REFERENCE NUMERALS

Figure 1:
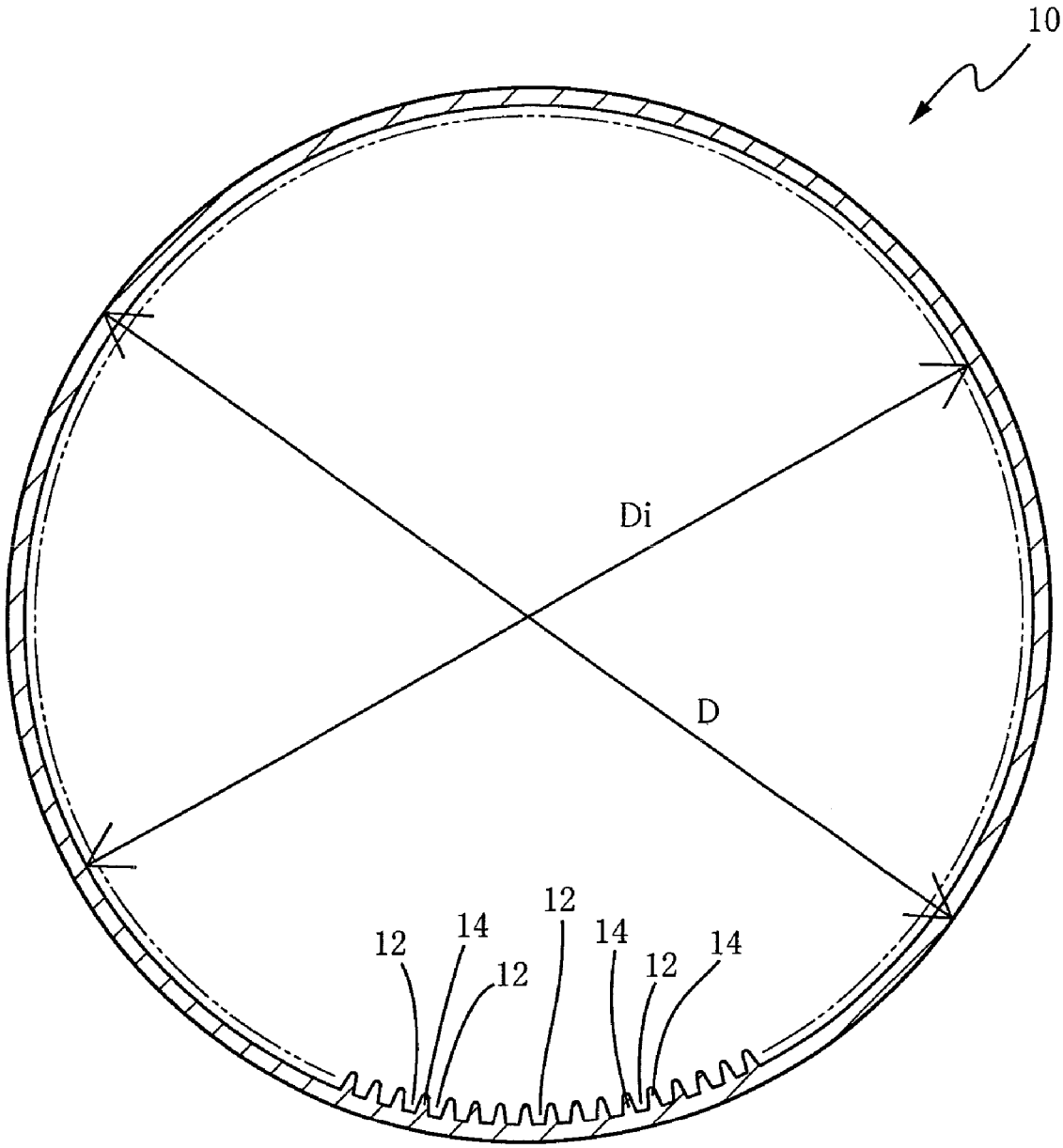
FIG. 1 is a cross sectional view showing one example of an internally grooved heat transfer tube used for a cross fin tube type heat exchanger according to the present invention.

10: heat transfer tube
12: internal grooves
14: internal fins

DETAILED DESCRIPTION OF THE INVENTION

Referring to the drawings, there will be explained in detail an internally grooved heat transfer tube for a high-pressure refrigerant according to the present invention to further clarify the invention.

Referring first to FIG. 1, there is shown one example of an internally grooved heat transfer tube for a high-pressure refrigerant according to the present invention, in a cross sectional view taken in a plane perpendicular to an axis of the tube. The heat transfer tube 10 is an internally grooved heat transfer tube made of a suitable metal material selected from copper, a copper alloy and the like, depending upon the required heat transfer performance, the kind of heat transmitting medium to be flowed in the heat transfer tube. As clearly shown in FIG. 1, the heat transfer tube 10 includes: a multiplicity of internal grooves 12 formed on an inner surface of the tube so as to extend in a circumferential direction of the tube or extend with a prescribed lead angle with respect to the tube axis; and a multiplicity of internal fins 14 each formed between adjacent two of the internal grooves 12, 12.

Figure 2:
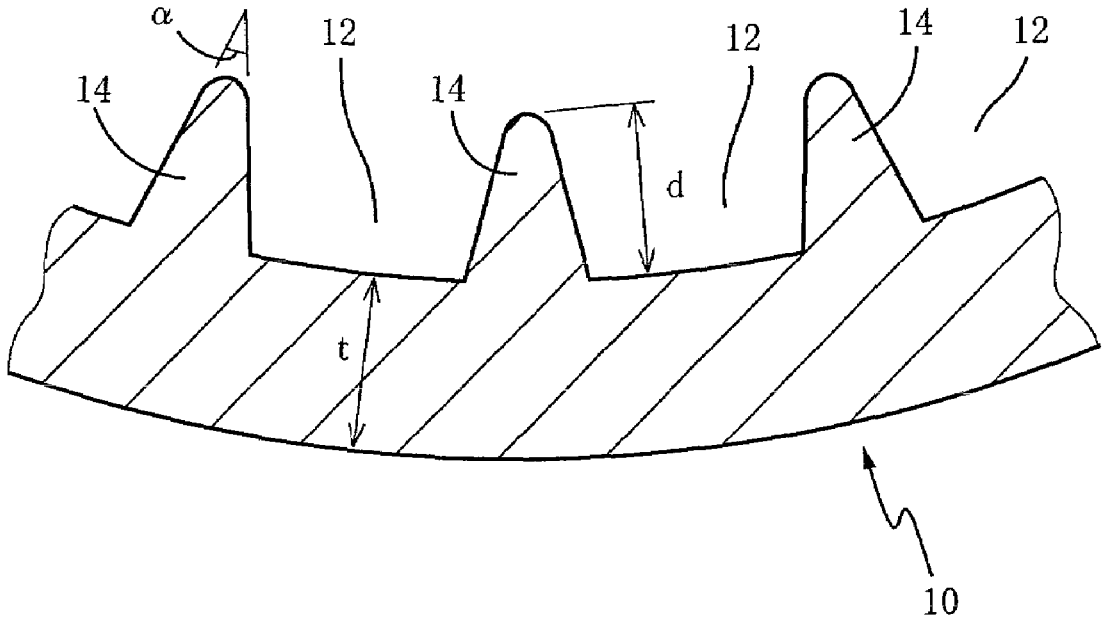
FIG. 2 is a partially enlarged cross sectional view of the internally grooved heat transfer tube of FIG. 1.

In detail, as shown in the enlarged view of FIG. 2 showing a part of a cut plane of the tube taken in a plane perpendicular to the tube axis, each of the internal grooves 12 formed on the inner surface of the tube has a depth "d" and a generally trapezoidal shape in which the width of the groove gradually decreases toward its bottom. The tube 10 has, at portions thereof corresponding to the respective internal grooves 12, a wall thickness "t" between the bottom of each groove 12 and an outer circumferential surface of the tube 10, namely, a groove bottom thickness "t". Each internal fin 14 is formed between adjacent two internal grooves 12, 12. In FIG. 2, each internal fin 14 has a generally trapezoidal shape with an arcuate top. The internal fin 14 may have a generally trapezoidal shape with a flat top or a triangular shape.

The heat transfer tube 10 is produced according to a known form rolling method, a rolling method or the like, as disclosed in JP-A-2002-5588, for instance. Where a form rolling apparatus shown in FIG. 4 of the Publication is used, during passing of a continuous raw tube through the form rolling apparatus, the raw tube is pressed between a grooved plug inserted in an inner hole of the raw tube and circular dies disposed radially outwardly of the raw tube, whereby the diameter of the raw tube is reduced and the intended grooves are formed continuously on the inner circumferential surface of the tube. Where the internally grooved heat transfer tube is produced according to the rolling method, an apparatus shown in FIG. 7 of the Publication is used, for instance. In detail, a continuous band plate is subjected to a suitable grooving working operation and a tube-forming working operation according to the rolling while being moved in its longitudinal direction, whereby the intended internally grooved heat transfer tube (10) is produced.

In the heat transfer tube 10, the outside diameter of the tube, the configuration of each internal groove 12, and the configuration of each internal fin 14 are determined such that the outside diameter (D) of the tube is in a range of 1-12 mm, preferably in a range of about 3-10 mm, a cross sectional area (A) of each groove is in a range of 0.004-0.038 $mm^2$, the groove depth (d) is in a range of 0.08-0.17 mm, and the groove bottom thickness (t) at a portion of the tube corresponding to each groove is in a range of 0.29-1.02 mm. Further, the heat transfer tube is arranged such that t/D is in a range from not smaller than 0.041 to not greater than 0.146 and $d^2/A$ is in a range from not smaller than 0.75 to not greater than 1.5. As the internal grooves 12 of the heat transfer tube 10, it is advantageous to employ a structure in which the lead angle of each groove 12 with respect to the tube axis is in a range of 10°-50° and an apex angle ($\alpha$) of each internal fin is in a range of 0°-50°, for assuring effective heat transfer performance and easiness of formation of the grooves by form rolling. Further, the number (N) of the internal grooves 12 formed on the inner surface of the tube is in a range of about 30-150 per circumference of the tube, preferably in a range of about 50-110 per circumference of the tube. In the present invention, N/Di is arranged to be in a range from not smaller than 8 to not greater than 24 where Di is a maximum inside diameter corresponding to an inside diameter of the tube formed by connecting bottoms of the grooves, in other words, where Di is equal to a value (D−2 t) obtained by subtracting twice the groove bottom thickness (t) from the outside diameter (D) of the tube.

In the existing technique of manufacturing the internally grooved heat transfer tube, the groove depth tends to be decreased in a case where the groove bottom thickness is increased, so that it is difficult to improve the heat transfer rate by increasing the groove depth. Accordingly, in the present invention, a reduction in the heat transfer area by the decrease in the groove depth is compensated with an increase in the number of the grooves, and the number of the grooves is suitably selected depending upon the groove depth, whereby the heat transfer rate in the tube (the intra-tube heat transfer rate) is improved.

Described more specifically, where the number of the grooves is excessively small with respect to the groove depth, it is difficult to obtain a heat transfer rate higher than that in the conventional tube due to a shortage of the heat transfer area and there may be a risk of destruction of tools used for forming the grooves due to an increased force applied to the tools during formation of the grooves. Where the number of the grooves is excessively large with respect to the groove depth, on the other hand, the risk of destruction of the tools is avoided. However, the grooves tend to be submerged in or filled with the refrigerant fluid, so that the effect of the grooves is not sufficiently exhibited, making it difficult to obtain a high heat transfer rate.

In view of the above, in the internally grooved heat transfer tube according to the present invention, the specifications of the heat transfer tube are determined to satisfy the above-indicated relational expressions, whereby the improvement in the intra-tubular heat transfer rate is achieved even where the strength for pressure resistance is improved by increasing the groove bottom thickness of the internally grooved heat transfer tube more than in the conventional tube. Namely, it is apparent that the strength for pressure resistance of the internally grooved heat transfer tube can be improved by increasing the groove bottom thickness more than that in the conventional tube. Because the groove bottom thickness required for a certain degree of strength for pressure resistance increases with an increase in the outside diameter of the tube, t/D is arranged to be held in the range from not smaller than 0.041 to not greater than 0.146 where the outside diameter of the tube is represented as D [mm] and the groove bottom thickness is represented as t [mm].

If t/D is smaller than 0.041, the improvement in the strength for pressure resistance cannot be expected as compared with the conventional internally grooved heat transfer tube for the following reasons: In one example of the conventionally used internally grooved heat transfer tube in which the outside diameter D of the tube is 7 mm and the groove bottom thickness t is 0.25 mm, upon considering a dimensional tolerance of ±0.03 mm in the working operation of the groove bottom thickness, t/D becomes equal to 0.04 where the groove bottom thickness is 0.28 mm with the upper limit of 0.03 mm of the dimensional tolerance. On the other hand, if t/D is larger than 0.146, the groove bottom thickness is excessively large with respect to the outside diameter of the tube, so that such an internally grooved heat transfer tube cannot be produced by the working technique under the present situation.

In the relationship between the groove depth d and the cross sectional area A of the groove, there is substantially no effect of increase in the heat transfer area and the grooves tend to be submerged in or filled with the refrigerant fluid if $d^2/A$ is smaller than 0.75. In this instance, the effect of the internal grooves is difficult to be obtained, and it is difficult to attain a high degree of intra-tubular heat transfer rate even when compared with the conventional tube. On the other hand, if $d^2/A$ is larger than 1.5, the cross sectional area of each groove is excessively small with respect to the groove depth, in other words, the number of the grooves are excessively large with respect to the outside diameter of the tube. In the existing working technique, the internally grooved heat transfer tube with such an excessively large number of the grooves cannot be produced, and the groove depth becomes too large. Accordingly, further improvement in the intra-tubular heat transfer rate cannot be expected. The reason for this is that, though the grooves are not likely to be submerged in or filled with the refrigerant fluid, the thickness of the fluid refrigerant becomes excessively large, rendering formation of a meniscus difficult. In this case, the effect of the grooves is difficult to be obtained.

In the relationship between the number N of the grooves and the maximum inside diameter Di of the heat transfer tube, a sufficiently high intra-tubular heat transfer rate cannot be obtained if N/Di is smaller than 8 because the number of the grooves is excessively small with respect to the inside diameter. On the other hand, if N/Di is larger than 24, the number of the grooves is excessively large with respect to the inside diameter, rendering formation of the grooves considerably difficult in producing such an internally grooved heat transfer tube. In this case, there may be caused a problem of deteriorated workability or productivity.

As noted above, by determining the specifications of the heat transfer tube 10 such as the outside diameter of the tube, the groove bottom, etc., so as to satisfy the above-indicated relational expressions, the improvement in the intra-tubular heat transfer rate is achieved even in a case where the strength for pressure resistance of the internally grooved heat transfer tube is improved by increasing the groove bottom thickness more than that in the conventional tube.

A cross fin tube type heat exchanger used generally in a refrigerating air-conditioning water supply apparatus and formed using the heat transfer tube 10 described above is produced in the following manner, for instance. Initially, by press working or the like using a suitable metal material such as aluminum or its alloy, there is formed a plate fin which is a plate member of a prescribed shape with a plurality of prescribed fixing holes formed therethrough. A plurality of the thus formed plate fins are superposed on one another with the fixing holes aligned with one another, and the heat transfer tubes 10 separately prepared from the plate fins are inserted in the fixing holes. Thereafter, the diameter of each heat transfer tube 10 is expanded according to the mechanical tube-expanding method or the like for fixing the heat transfer tubes 10 to the plate fins. Thus, there is formed a cross fin tube in which the plate fins on the air side and the heat transfer tubes on the refrigerant side are assembled integrally with each other. To the thus obtained cross fin tube, known components such as a header and a U-bend tube for connecting the heat transfer tubes are attached, whereby a cross fin tube type heat exchanger is assembled to have a structure similar to that in the convention one.

In the cross fin tube type heat exchanger formed using the heat transfer tube 10 described above, the operating pressure can be increased up to 5-15 MPa owing to the improvement in the strength for pressure resistance of the heat transfer tube 10, from a comparatively low operating pressure of about 1-4 MPa in the conventional heat exchanger. Therefore, among the conventionally used refrigerants for the heat exchanger, it is possible to suitably use various high-pressure refrigerants such as the HFC refrigerants including R-32 and used at a comparatively high pressure, and the carbon dioxide gas used at a particularly high pressure.

EMBODIMENT

The characteristic of the present invention will be further clarified by indicating an embodiment of the invention. It is to be understood that the invention is not limited to the description of the embodiment.

Initially, as test heat transfer tubes, there are prepared internally grooved heat transfer tubes according to Examples 1-6 having mutually different specifications shown in the following TABLE 1. In each of those test heat transfer tubes, a multiplicity of internal grooves are formed as spiral grooves on the inner surface of the tube so as to extend with a prescribed inclination angle (lead angle) with respect of the tube axis. Further, the outside diameter, the groove bottom thickness, the groove depth, the cross sectional area of each groove, and the number of grooves are determined so as to satisfy the relational expressions according to the present invention. For comparison, there is prepared, as a Comparative example 1, a tube having ordinary specifications of a high-performance internally grooved tube which has been presently put to practice. Further, there are prepared, as Comparative examples 2-5, tubes in which the relationship between the outside diameter of the tube and the cross sectional area of each groove or the relationship between the number of the grooves and the maximum inside diameter of the tube does not satisfy the above-indicated relational expressions. The specifications of those comparative examples are also shown in TABLE 1. In all of the test tubes according to Examples 1-6 and Comparative examples 1-5, the apex angle on each internal fin and the inclination angle (the lead angle) of each groove are 40° and 18°, respectively.

TABLE 1

| | Outside diameter D [mm] | Maximum inside diameter Di [mm] | Groove bottom thickness t [mm] | Groove depth d [mm] | Number N of grooves [per circumference] | Groove cross sectional area A [$mm^2$] | t/D | $d^2/A$ | N/Di |
|---|---|---|---|---|---|---|---|---|---|
| Example 1 | 7.00 | 6.42 | 0.29 | 0.17 | 55 | 0.0380 | 0.041 | 0.76 | 8.6 |
| Example 2 | 7.00 | 6.16 | 0.42 | 0.16 | 70 | 0.0225 | 0.060 | 1.14 | 11.4 |
| Example 3 | 7.00 | 5.88 | 0.56 | 0.14 | 75 | 0.0170 | 0.080 | 1.15 | 12.8 |
| Example 4 | 7.00 | 5.60 | 0.70 | 0.12 | 80 | 0.0120 | 0.100 | 1.20 | 14.3 |
| Example 5 | 7.00 | 5.28 | 0.86 | 0.10 | 90 | 0.0075 | 0.123 | 1.33 | 17.0 |
| Example 6 | 7.00 | 4.96 | 1.02 | 0.08 | 100 | 0.0043 | 0.146 | 1.49 | 20.2 |
| Comparative example 1 | 7.00 | 6.50 | 0.25 | 0.18 | 50 | 0.0470 | 0.036 | 0.69 | 7.7 |
| Comparative example 2 | 7.00 | 6.42 | 0.29 | 0.17 | 50 | 0.0440 | 0.041 | 0.66 | 7.8 |
| Comparative example 3 | 7.00 | 6.16 | 0.42 | 0.16 | 55 | 0.0350 | 0.060 | 0.73 | 8.9 |
| Comparative example 4 | 7.00 | 4.96 | 1.02 | 0.09 | 100 | 0.0050 | 0.146 | 1.62 | 20.2 |
| Comparative example 5 | 7.00 | 4.96 | 1.02 | 0.08 | 110 | 0.0033 | 0.146 | 1.94 | 22.2 |

For each of the test tubes prepared as described above, the strength for pressure resistance was measured in the following manner: For each of the test tubes shown in the above TABLE 1, five samples each having a length of 300 mm were prepared by cutting each test tube. On the samples of each test tube, the following hydraulic pressure test was performed: With one open end of each sample tube closed, water poured from the other open end into the sample tube was pressurized by a hydraulic pressure generating device such that pressure is gradually increased, and the pressure at which the test tube was broken was measured. There were measured breaking pressure values for the respective five samples of each test tube. An average value of the five breaking pressure values for each test tube is indicated in the following TABLE 2 as the measuring results.

TABLE 2

| | t/D | Breaking stress Pmax [MPa] |
|---|---|---|
| Comparative Example 1 | 0.036 | 13.7 |
| Example 1 | 0.041 | 15.7 |
| Example 2 | 0.060 | 24.0 |
| Example 3 | 0.080 | 32.3 |
| Example 4 | 0.100 | 41.7 |
| Example 5 | 0.123 | 52.4 |
| Example 6 | 0.146 | 63.7 |

As apparent from the results shown in the above TABLE 2, the breaking pressure in Comparative example 1 is obviously less than 15 MPa that is a pressure value desired at the time of use of the high-pressure gas refrigerant. On the other hand, the breaking pressures in all of Examples 1-6 exceed 15 MPa. It is therefore recognized that the strength for pressure resistance in each of Examples 1-6 is improved as compared with the conventional ordinary heat transfer tube according to Comparative example 1. It is further understood that the breaking pressure is increased, namely, the strength for pressure resistance of the heat transfer tube is improved, in accordance with the increase in the groove bottom thickness.

Figure 3A:
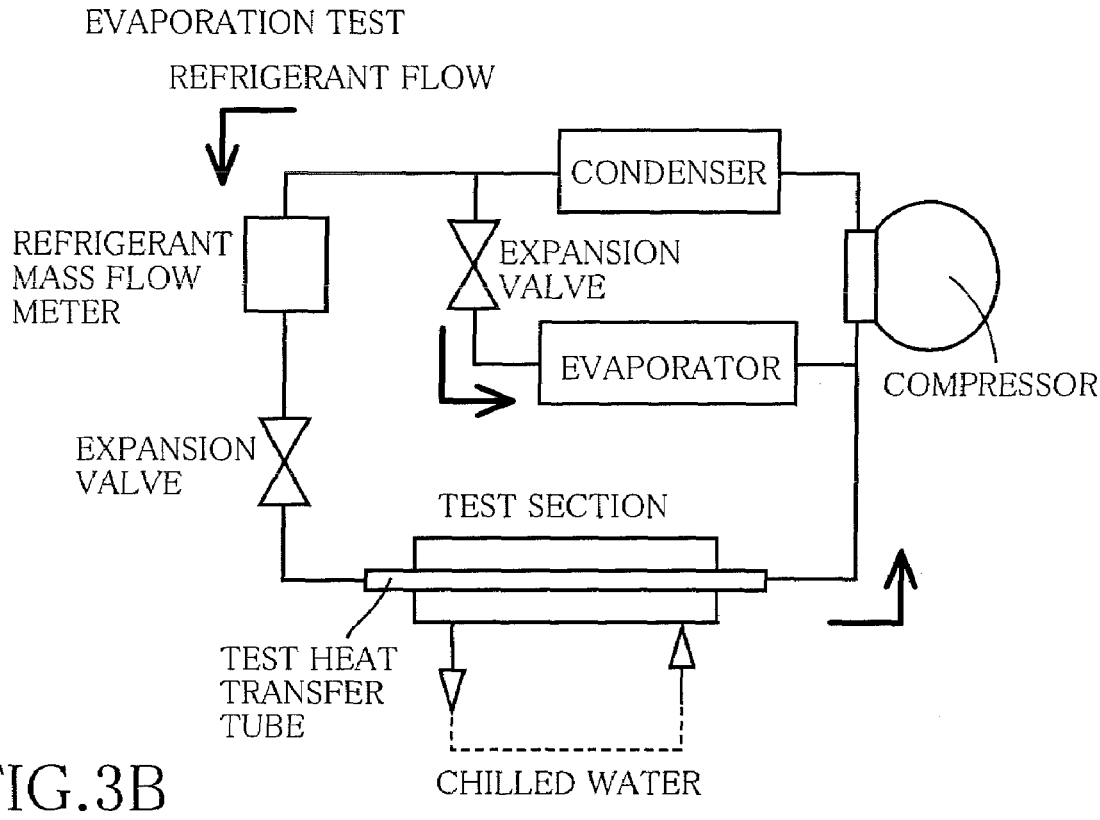
FIGS. 3A and 3B are views showing circulating states of a refrigerant in an evaporation test and a condensation test, respectively, in a test device for measuring a single-tube performance of the internally grooved heat transfer tube in the embodiment.
Figure 3B:
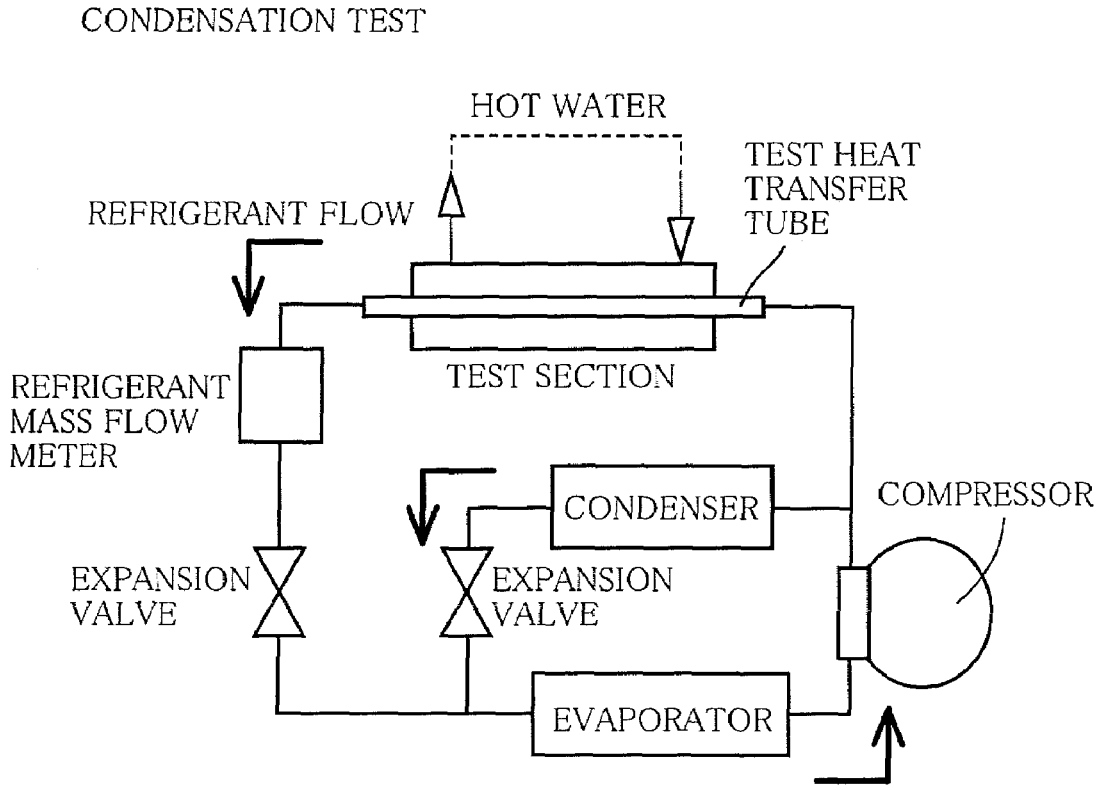

Next, a single-tube performance evaluation test was performed on each of those test tubes prepared as described above, in order to examine an intra-tubular heat transfer rate. The single-tube performance evaluation test was performed in the following manner: Each of the test tubes was installed in a single-tube state on a test section of a known heat transfer performance test apparatus. Under respective circulating states of the refrigerant shown in FIGS. 3A and 3B, performance tests were carried out under respective test conditions indicated in the following TABLE 3. The results of the tests are indicated in the following TABLE 4. As the refrigerant, there was used R-32 as one example of the refrigerants used at a higher pressure than the other refrigerants. The tests were carried out at a region in a refrigerant mass velocity of 200-300 kg/($m^2$·s) which substantially coincides with an actual operating condition of air-conditioning equipment. In the following TABLE 4, the ratio of the intra-tubular heat transfer rate in each of Examples 1-6 indicates the ratio of the intra-tubular heat transfer rate thereof with respect to or on the basis of the heat transfer rate of Comparative example 1.

TABLE 3

| | Evaporation performance test | Condensation performance test |
|---|---|---|
| Vapor saturation temperature | 2° C. | 50° C. |
| Inlet condition | Quality of vapor = 0.2 | Degree of superheat = 40° C. |
| Outlet condition | Degree of superheat = 5° C. | Degree of supercooling = 5° C. |
| Refrigerant mass velocity | 200, 300 [kg/m$^2$ · s] | |

TABLE 4

| | Intra-tubular evaporation heat transfer ratio | | Intra-tubular condensation heat transfer ratio | |
|---|---|---|---|---|
| | 200 kg/(m$^2$ · s) | 300 kg/(m$^2$ · s) | 200 kg/(m$^2$ · s) | 300 kg/(m$^2$ · s) |
| Comparative Example 1 | 1.00 | 1.00 | 1.00 | 1.00 |
| Comparative Example 2 | 0.91 | 0.98 | 0.95 | 0.97 |
| Comparative Example 3 | 1.00 | 1.00 | 1.00 | 1.00 |
| Comparative Example 4 | 0.98 | 0.88 | 0.96 | 0.84 |
| Comparative Example 5 | 0.78 | 0.64 | 0.71 | 0.62 |
| Example 1 | 1.05 | 1.08 | 1.03 | 1.04 |
| Example 2 | 1.21 | 1.34 | 1.11 | 1.16 |
| Example 3 | 1.22 | 1.35 | 1.11 | 1.16 |
| Example 4 | 1.22 | 1.35 | 1.11 | 1.16 |
| Example 5 | 1.21 | 1.33 | 1.09 | 1.13 |
| Example 6 | 1.17 | 1.27 | 1.05 | 1.08 |

As apparent from the results indicated in the above TABLE 4, in each of the heat transfer tubes according to Examples 1-6 wherein the relationship between the outside diameter of the tube and the groove bottom thickness, and the relationship between the cross sectional area of each groove and the groove depth satisfy the relational expressions according to the present invention, it is recognized that both of the intra-tubular heat transfer rate at the time of evaporation and the intra-tubular heat transfer rate at the time of condensation are improved. In the heat transfer tube according to Example 1, for instance, in spite of reduction in the groove depth by 0.01 mm as compared with the tube according to Comparative example 1, the intra-tubular heat transfer rates at the time of evaporation and at the time of condensation are increased as a result of an increase in the number of the grooves by five. Further, in Example 1, the strength for pressure resistance is improved by 15% as a result of an increase in the groove bottom thickness by 0.04 mm.

In the heat transfer tube according to Example 2, the strength for pressure resistance is improved by 75% as a result of an increase in the groove bottom thickness by 0.17 mm as compared with the tube according to Comparative example 1, and the intra-tubular heat transfer rates at the time of evaporation and at the time of condensation are increased as compared with the tube according to Comparative example 1 as a result of an increase in the number of the grooves by 20, in spite of a reduction in the groove depth by 0.02 mm. In the heat transfer tube according to Example 3, the strength for pressure resistance is improved by about 136% as a result of an increase in the groove bottom thickness by 0.31 mm as compared with the tube according to Comparative example 1. Further, in spite of a reduction in the groove depth by 0.04 mm, the intra-tubular heat transfer rates at the time of evaporation and at the time of condensation are improved as compared with the tube according to Comparative example 1 as a result of an increase in the number of the grooves by 25. Moreover, in Examples 4, 5 and 6, the strength for pressure resistance is improved by 204-365% as a result of an increase in the groove bottom thickness by 0.45-0.77 mm as compared with the tube according to Comparative example 1. Further, in spite of a reduction in the groove depth by 0.06-0.10 mm, the intra-tubular heat transfer rates at the time of evaporation and at the time condensation are improved as a result of an increase in the number of the grooves by 30-50.

On the contrary, in the tubes according to Comparative examples 2-5 wherein the relationship between the groove depth and the cross sectional area of each groove or the relationship between the number of the grooves and the maximum inside diameter of the tube does not satisfy the relational expressions according to the present invention though the relationship between the outside diameter of the tube and the groove bottom thickness satisfies the relational expression, it is recognized that the intra-tubular heat transfer rates both at the times of evaporation and condensation are lowered than in the tube according to Comparative example 1 though the strength for pressure resistance is improved as a result of an increase in the groove bottom thickness.

What is claimed is:

1. An internally grooved heat transfer tube for a high-pressure refrigerant which is used for a cross fin tube type heat exchanger using a high-pressure refrigerant and which is formed of copper or a copper alloy, the heat transfer tube including: a multiplicity of grooves formed in an inner surface thereof so as to extend in a circumferential direction of the tube or extend with a predetermined lead angle with respect to an axis of the tube; and internal fins having a predetermined height and each formed between adjacent two of the multiplicity of grooves, characterized in that:

t/D ranges from not smaller than 0.060 to not greater than 0.146 and $d^2/A$ ranges from not smaller than 0.75 to not greater than 1.5 where an outside diameter of the tube is represented as D(mm), a groove bottom thickness which is a wall thickness of the tube at a portion thereof corresponding to each groove is represented as t (mm), a depth of each groove is represented as d (mm), and a cross sectional area of each groove taken in a cross sectional plane perpendicular to the axis of the tube is represented as A (mm$^2$); and N/Di ranges from not smaller than 8 to not greater than 24 where a number of the multiplicity of grooves is represented as N and a maximum inside diameter of the tube which corresponds to an inside diameter of the tube formed by connecting bottoms of the multiplicity grooves is represented as Di.

2. The internally grooved heat transfer tube according to claim 1, wherein the high-pressure refrigerant has a pressure of 5-15 MPa.

3. The internally grooved heat transfer tube according to claim 1, wherein the high-pressure refrigerant is a carbon dioxide gas.

4. The internally grooved heat transfer tube according to claim 1, wherein each of the internal fins has a transverse cross sectional shape of a trapezoidal shape with a flat or arcuate top or a triangular shape.

5. The internally grooved heat transfer tube according to claim 1, wherein the outside diameter (D) of the tube is in a range of 1-12 mm.

6. The internally grooved heat transfer tube according to claim 1, wherein the groove bottom thickness (t) is in a range of 0.29-1.02 mm.

7. The internally grooved heat transfer tube according to claim 1, wherein the depth (d) of each groove is in a range of 0.08-0.17 mm.

8. The internally grooved heat transfer tube according to claim 1, wherein the cross sectional area (A) of each groove is in a range of 0.004-0.038 $mm^2$.

9. The internally grooved heat transfer tube according to claim 1, wherein the number (N) of the multiplicity of grooves is in a range of 30-150 per circumference of the tube.

10. The internally grooved heat transfer tube according to claim 1, wherein the lead angle of the multiplicity of grooves with respect to the axis of the tube is in a range of 10°-50°.

11. The internally grooved heat transfer tube according to claim 1, wherein each of the internal fins has an apex angle in a range of 0°-50°.

12. A refrigerating air-conditioning water supply device with a cross fin tube type heat exchanger formed by using an internally grooved heat transfer tube defined in claim 1.

* * * * *